US005987855A

United States Patent [19]

Dey et al.

[11] Patent Number: 5,987,855

[45] Date of Patent: Nov. 23, 1999

[54] METHOD OF AND APPARATUS FOR SEALING SURGICAL SUTURE PACKAGES

[75] Inventors: Clifford A. Dey, Lebanon, N.J.; Milton Cary Houston, Miles, Tex.; David A. Szabo, Branchburg, N.J.

[73] Assignee: Ethicon, Inc., San Angelo, Tex.

[21] Appl. No.: 08/888,185

[22] Filed: Jul. 3, 1997

[51] Int. Cl.[6] ..... B65B 51/10

[52] U.S. Cl. ..... 53/477; 53/53; 53/373.7; 53/375.9

[58] Field of Search ..... 53/477, 453, 559, 53/53, 425, 426, 54, 373.7, 375.9

[56] References Cited

U.S. PATENT DOCUMENTS

| | | | |
|---|---|---|---|
| 3,162,307 | 12/1964 | Regan, Jr. | 206/63.3 |
| 3,163,288 | 12/1964 | Arvidsson | 206/63.3 |
| 3,256,981 | 6/1966 | Kurtz | 206/56 |
| 3,724,651 | 4/1973 | Link | 206/56 |
| 3,809,230 | 5/1974 | Poncy | 206/306 |
| 3,967,729 | 7/1976 | Tanner, II | 206/438 |
| 3,980,177 | 9/1976 | McGregor | 206/63.3 |
| 4,261,463 | 4/1981 | Shave | 206/63.3 |
| 4,615,926 | 10/1986 | Hsu et al. | 428/35 |
| 4,918,907 | 4/1990 | Roach et al. | 53/53 |
| 4,961,498 | 10/1990 | Kalinski et al. | 206/339 |
| 4,967,902 | 11/1990 | Sobel et al. | 206/63.3 |
| 5,048,678 | 9/1991 | Chambers | 206/63.3 |
| 5,081,816 | 1/1992 | Cardinali | 53/559 |
| 5,127,211 | 7/1992 | Mancini | 53/477 |
| 5,129,511 | 7/1992 | Brown et al. | 206/63.3 |
| 5,220,769 | 6/1993 | Brown et al. | 53/453 |
| 5,249,406 | 10/1993 | Kalmanides | 53/387.2 |
| 5,284,240 | 2/1994 | Alpern et al. | 206/63.3 |
| 5,341,922 | 8/1994 | Cerwin et al. | 206/63.3 |
| 5,439,102 | 8/1995 | Brown et al. | 206/63.3 |
| 5,568,715 | 10/1996 | Ebel et al. | 53/54 |
| 5,623,810 | 4/1997 | Dey et al. | 53/425 |
| 5,709,067 | 1/1998 | Dey et al. | 53/53 |
| 5,732,529 | 3/1998 | Dey et al. | 53/559 |

*Primary Examiner*—James F. Coan
*Assistant Examiner*—Gene L Kim
*Attorney, Agent, or Firm*—Herbert J. Hammond

[57] ABSTRACT

A method of and apparatus for sealing unsealed surgical suture packages by applying heat and sealing pressure substantially simultaneously to both the sealed edge and the unsealed edge of an unsealed surgical suture package, thereby forming a sealed surgical suture package.

21 Claims, 3 Drawing Sheets

METHOD OF AND APPARATUS FOR SEALING SURGICAL SUTURE PACKAGES

FIELD OF THE INVENTION

The present invention relates generally to packaging and more particularly to a method of and apparatus for sealing unsealed or partially sealed surgical suture packages.

DESCRIPTION OF THE PRIOR ART

Automatic procedures are employed to package surgical suture products in a sterile condition for shipment and subsequent use in surgery. As part of the packaging procedure, needle-suture assemblies are retained in a packet comprising a plastic tray and a paper lid. The packet containing the needle-suture assembly is sealed between two metal foils that comprise a sterile package. The sterile package has a cavity within which the suture packet resides. A seal is formed around the cavity by pressing the two foils together using a heated die mechanism which melts thin polymer coatings on the facing surfaces of the foils in the area exposed to the heated die.

In the manufacturing operation, a plurality of packets are partially sealed between the top and bottom foils to form an unsealed package. The unsealed packages are generally rectangular and they are sealed at both ends and along one side. The spaces between the packets are also sealed. The package, with the unsealed or partially sealed edge, is exposed to a sterilizing agent, such as ethylene oxide gas, to sterilize the suture packet and the interior of the foil package. Then, the unsealed edge is sealed and the sealed package is processed through a blanking machine to cut the package into individual foil packs. The packaging of surgical suture packages according to the prior art is described in U.S. Pat. No. 5,623,810.

A problem area in the process for packaging surgical sutures is in sealing the unsealed edge of the foil package. The unsealed edge is sealed by inserting the package between a pair of sealing dies and moving the sealing dies into sealing contact with the unsealed edge. The operator must insert the package between the sealing dies correctly. Occasionally, an operator will insert the sealed edge of the package between the sealing dies, which results in an open seal. Additionally, alignment within the sealing dies is critical. Any misalignment can result in a punctured package or crushed cavity.

Surgical sutures demand the highest quality control and no packaging defects can be tolerated. Any defective packages must be disposed of. The manufacture and packaging of surgical sutures is very expensive. Thus, it is very costly to have to scrap packaged needle-suture combinations at a late stage in the manufacturing and packaging process.

SUMMARY OF THE INVENTION

The present invention provides a method of and apparatus for sealing unsealed surgical suture packages. The unsealed surgical suture packages include a bottom foil sheet with a heat sealable coating on its top surface and top foil sheet with a heat sealable coating on its bottom surface. The unsealed surgical suture packages are generally rectangular in shape, with one sealed edge and one unsealed edge. The method includes the step of applying heat and sealing pressure substantially simultaneously to both the sealed edge and the unsealed edge of an unsealed surgical suture package, thereby forming a sealed surgical suture package.

The step of applying heat and sealing pressure includes the step of placing the unsealed surgical suture package between a first sealing die and a second sealing die. Each of the first and second sealing dies includes pair of spaced apart sealing surfaces. The sealing surfaces of at least one of the sealing dies are heated. The method moves the first and second sealing dies toward each other to apply heat and sealing pressure to the edges of the package.

The method conveys properly sealed surgical suture packages from a position between said sealing dies to a sealed package receptacle. The method conveys improperly sealed surgical suture package from a position between said sealing dies to a waste receptacle.

The apparatus of the present invention includes a loading station adapted to receive unsealed packages and a discharge station adapted to discharge sealed packages. The apparatus includes a belt driven in a path to move a package between the loading station and the discharge station. A sealing station is positioned along the path of the belt between the loading station and the discharge station. The sealing station includes a first sealing die, including pair of spaced apart sealing surfaces, and a second sealing die, also including a pair of spaced apart sealing surfaces. The first and second sealing dies are spaced apart from each other and means are provided for moving the first and second sealing dies toward and away from each other.

A sealed package receptacle and a waste receptacle are positioned adjacent the discharge station. The discharge station includes a ramp positioned to receive packages from the belt and feed packages the sealed package receptacle. Means are provided for selectively moving the ramp out of its package receiving position, thereby allowing packages to move from said belt into the waste receptacle.

Preferably, the apparatus of the present invention is arrange to seal unsealed packages of surgical sutures two at a time. The loading station is adapted to receive unsealed packages two at time side by side. A pair of belts are driven in a path to move a packages side by side between the loading station and the discharge station. The sealing station includes a first sealing die, having a pair of spaced apart inner sealing surfaces and a pair of spaced apart outer sealing surfaces, and a second sealing die, also having a pair of spaced apart inner sealing surfaces and a pair of spaced apart outer sealing surfaces.

The sealing station includes alignment means for aligning the packages between the sealing dies. The alignment means includes a first alignment bar positioned between the inner sealing surfaces of the sealing dies and a pair of second alignment bars positioned outboard of the outer sealing surfaces of the sealing dies. The second alignment bars are movable in and out, toward and away from, the first alignment bar.

DESCRIPTION OF THE PREFERRED EMBODIMENT

Figure 1:
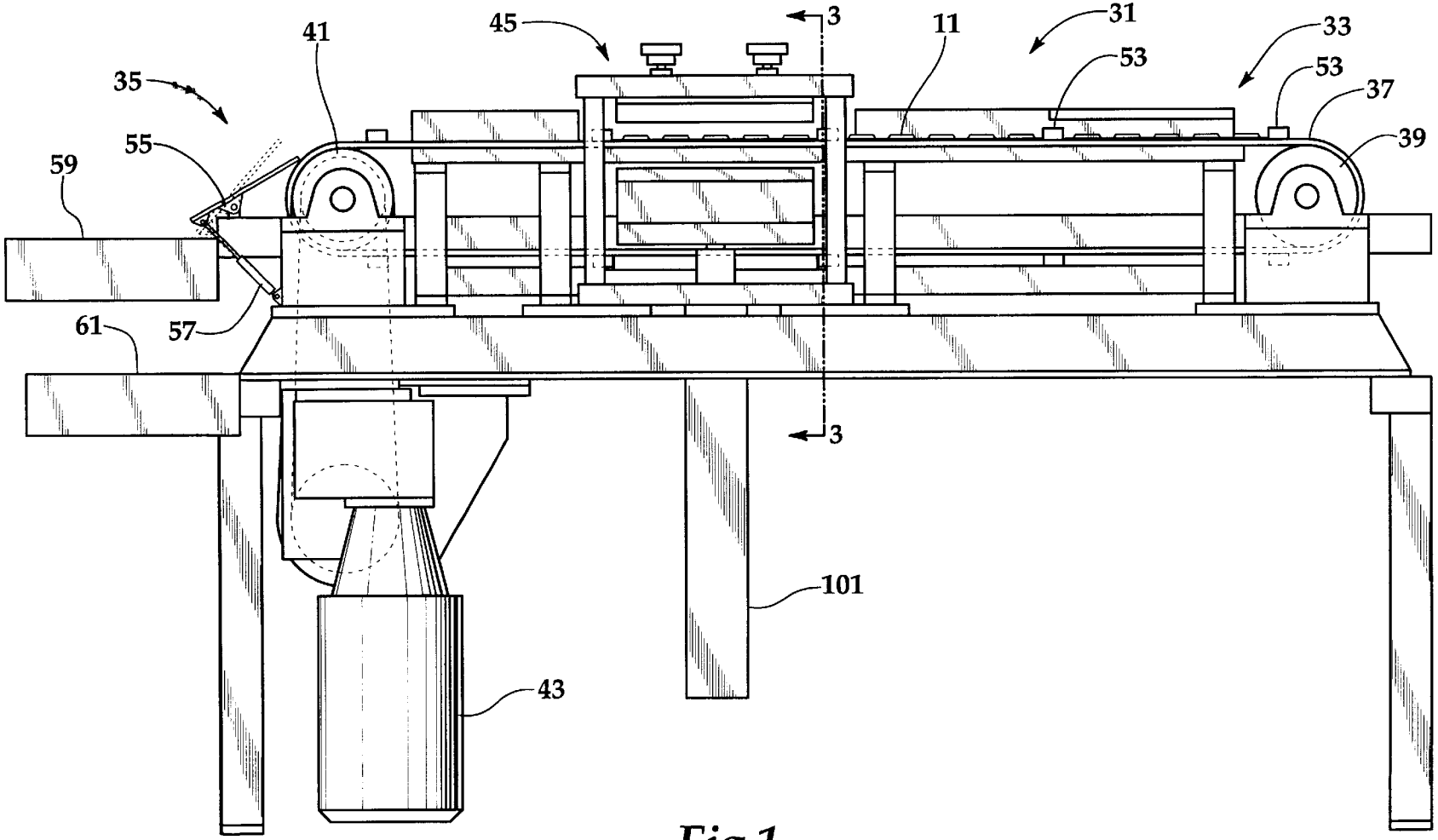
FIG. 1 is a side view of the preferred embodiment of the apparatus of the present invention.
Figure 2:
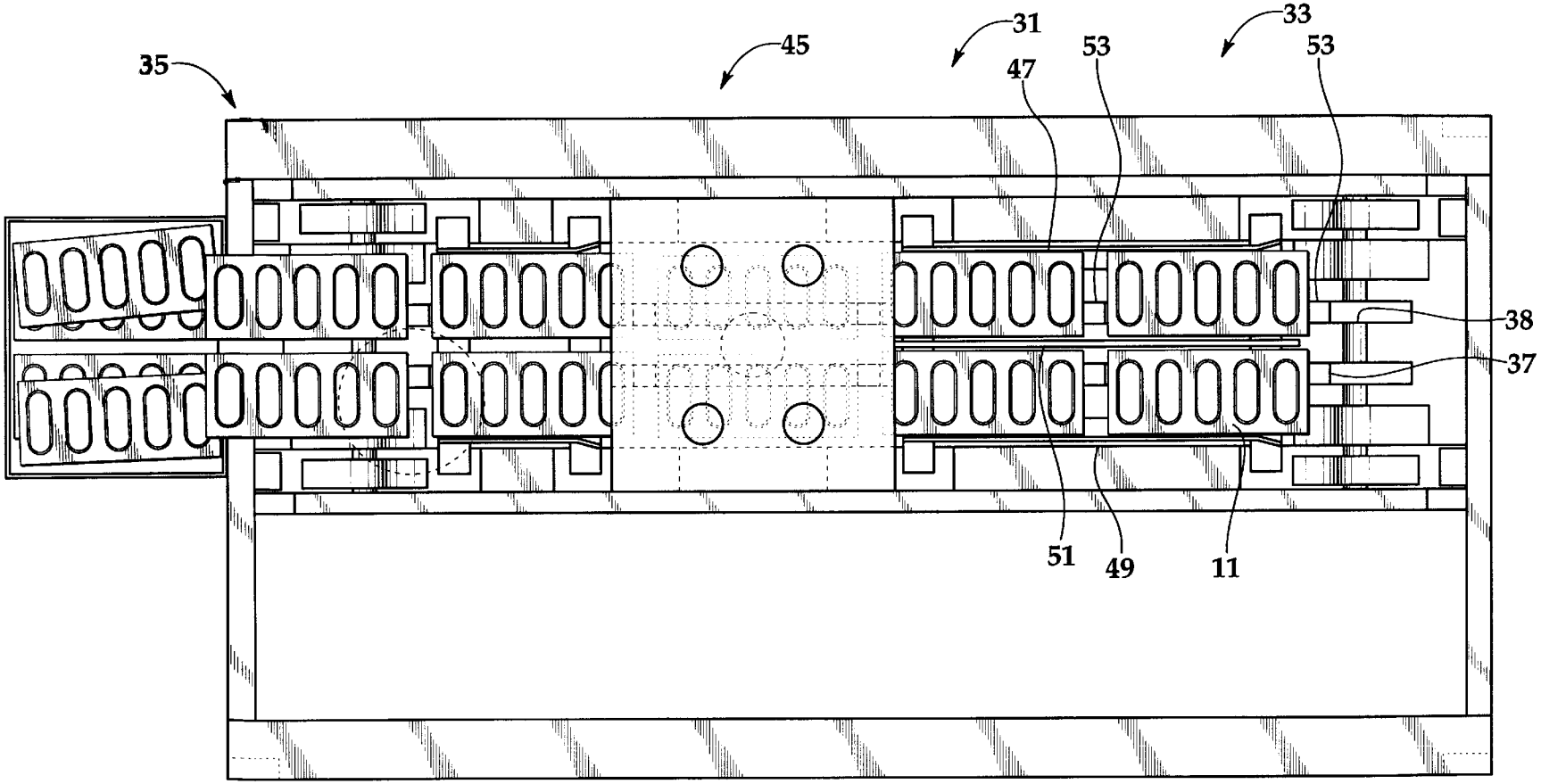
FIG. 2 is top view of the preferred embodiment of the apparatus of the present invention.
Figure 3:
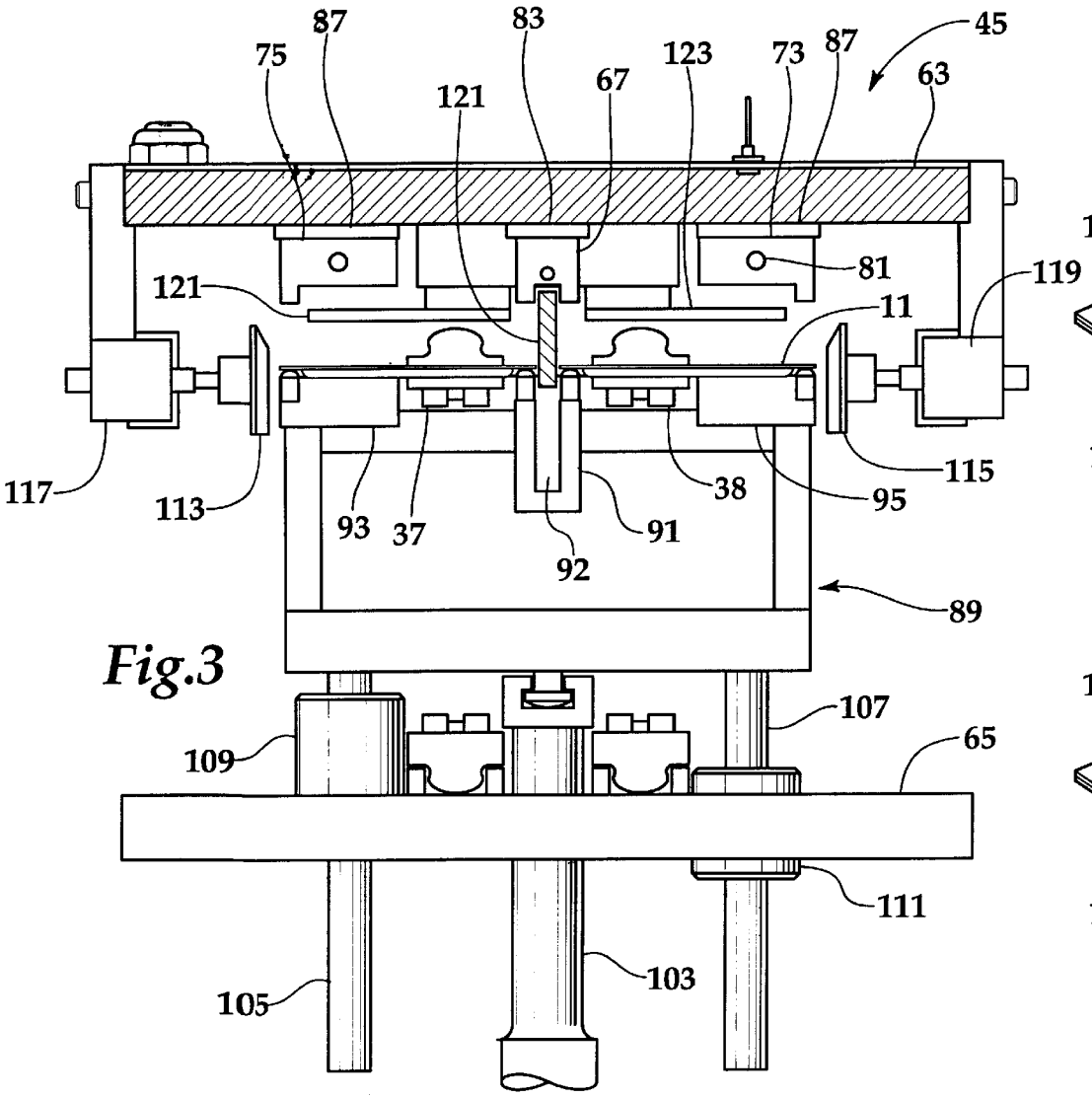
FIG. 3 is a sectional view taken generally along line 3—3 of FIG. 1 showing details of a sealing station according to the present invention.

Referring now to the drawings, the preferred embodiment of the apparatus of the present invention is illustrated in FIGS. 1–3. The apparatus of the present invention is adapted to seal surgical suture package, such as those illustrated in FIGS. 4 and 5.

Figure 4:
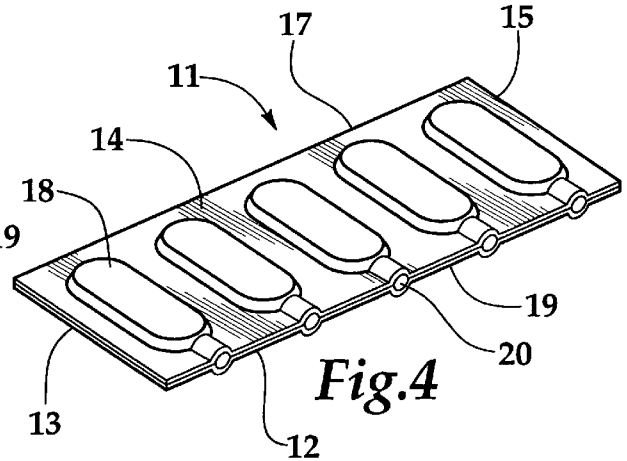
FIG. 4 is a perspective view of an unsealed surgical suture package.
Figure 5:
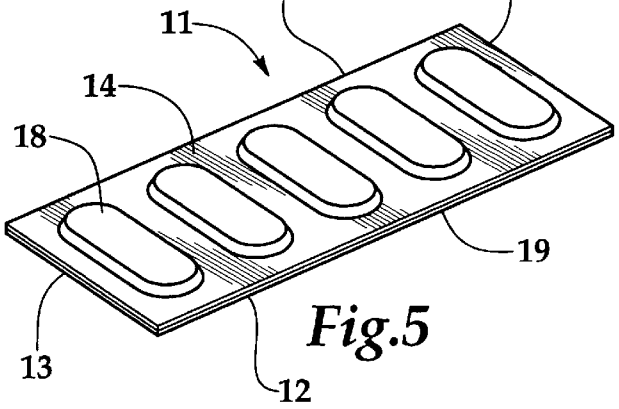
FIG. 5 is a perspective view of a sealed surgical suture package.

Referring to FIGS. 4 and 5, a surgical suture package is designated generally by the numeral 11. Package 11 is formed of a top foil sheet 12 and a bottom foil sheet 14, each being coated with a heat sealable material. Package 11 is generally rectangular in shape, and it includes sealed ends 13 and 15 and a sealed side edge 17. Suture packets are contained in cavities 18 formed in one of the foil sheets comprising package 11. The foil sheets are sealed together in the areas around cavities 18.

In the unsealed condition, as illustrated in FIG. 4, the side 19 opposite side 17 is unsealed to enable sterilizing gas to enter the interior of package 11 through a plurality of vents 20. In the sealed condition, as illustrated in FIG. 5, side 19 is sealed by the method and apparatus of the present invention. After side 19 is sealed, package 11 is passed to a blanking machine, where individual packs are cut out of package 11.

Referring now to FIGS. 1 and 2, the apparatus of the present invention is designated generally by the numeral 31. Apparatus 31 includes a loading station, designated generally by the numeral 33, adapted to receive unsealed packages, and a discharge station, designated generally by the numeral 35, adapted to receive sealed packages. A pair of parallel endless belts 37 and 38 are trained for rotation on rollers 39 and 41 to convey packages 11 between loading station 33 and discharge station 35. Belt 37 is driven by means of a motor 43 and a suitable transmission, partially shown in phantom in FIG. 1. A sealing station, designated generally by the numeral 45, is disposed along the path of belt 37 between loading station 33 and discharge station 35. Apparatus 31 is preferably supported by a table-like structure in a sterile cleanroom environment.

Referring particularly to FIG. 2, loading station 33 includes a pair of spaced apart side walls 47 and 49 and a center wall 51. Side walls 47 and 49 are spaced apart from center wall 59 a distance greater than the width, but less than the length, of a package 11. Side walls 47 and 49 and center wall 51, together with belts 37 and 38, form a pair of loading trays into which an operator may load packages 11 side by side two at a time. As shown in FIGS. 1 and 2, belt 37 includes a plurality of lugs 53 spaced linearly along each belt at a distance substantially equal to the length of a package 11.

As best shown in FIG. 1, discharge station 35 includes a ramp 55 pivotly mounted adjacent roller 41. Ramp 55 is moveable by means of a pneumatic cylinder 57 between a first position and a second position, which is shown in phantom in FIG. 1. In the first position, packages 11 slide along ramp 55 from belt 37 into a sealed needle receptacle 59. In the second position, packages 11 fall from the end of belt 37 into a waste receptacle 61. As will described in detail hereinafter, pneumatic actuator 57 is operated to move ramp 55 from the first position to the second position when logic in a controller (not shown) indicates that a package 11 may not be sealed properly.

Referring now to FIG. 3, there is shown details of sealing station 45. Sealing station 45 includes a fixed upper plate 63 and a fixed lower plate 65. Upper plate 63 supports a sealing die that includes an inner member 67, having a pair of spaced apart inner sealing surfaces, and a pair of spaced apart outer sealing members 73 and 75, each having a sealing surface. Each of sealing members 67, 73 and 75 include a temperature controlled heating element, as for example heating element 81 of outer sealing member 77, that is adapted to heat each sealing member to a maximum temperature of about 220° C., with a preferred temperature about 175° C. The preferred temperature is determined according to the packaging material. Suitable sensors, such as thermocouples (not shown) are provided for monitoring and controlling the temperature of the heated sealing members. Insulating members 83, 85, and 87 are mounted between upper plates 63 and heated sealing members 67, 73 and 75, respectively.

A moveable assembly designated generally by the numeral 89 is positioned between upper plate 63 and lower plate 65 to form a lower sealing die. Assembly 89 includes an inner sealing member 91, having a pair of spaced apart elastomeric inner sealing surfaces, and a pair of outer sealing members 93 and 95, each having an elastomeric sealing surface.

Assembly 89 is moveable up and down by means of a pneumatic actuator 101 (shown in FIG. 1) that includes an actuator rod 103. As shown in FIG. 3, actuator rod 103 is pivotly mounted to allow assembly 89 to float so as to allow the lower sealing surfaces to seal properly against the upper sealing surfaces. Assembly 89 is stabilized by means of guide rods 105 and 107 that move through bushings 109 and 111, respectively in lower plate 65.

Packages 11 are carried into and out of sealing station 45 by means of belts 37 and 38, which are carried in ways in assembly 89. As shown in FIG. 3, a pair of packages are supported side by side within sealing station 45 with the edges of the packages supported by the sealing surfaces of sealing members 91, 93, and 95. The packages are aligned within sealing station 45 by means of an alignment system, that includes a pair of moveable alignment bars 113 and 115 supported by upper plate 63 on opposite sides of assembly 89. Alignment bars 113 and 115 are moveable in and out with respect to assembly 89 by means of pneumatic actuators 117 and 119, respectively. A central alignment bar 121 is supported between the sealing surfaces of central sealing member 67. Central sealing member 91 of assembly 89 has a longitudinal extending slot 92 adapted to receive central alignment bar 121 as assembly 89 moves upwardly. Actuation of pneumatic actuators 117 and 119 urge alignment bars 113 and 115 inwardly thereby to force packages 11 into engagement with central alignment bar 121. Thus, packages 11 are properly aligned with the sealing surfaces as assembly 89 moves upwardly.

Spring biased plates 121 and 123 are positioned between upper plate 63 and assembly 89. As assembly 89 moves upwardly, plates 121 and 123 engage packages 11 to hold them in place between the upper and lower sealing dies.

In operation, an operator places a pair of unsealed packages 11 side by side in receiving station 33. With the packages properly in place, the operator actuates a switch or the like, to cause motor 43 to index belts 37 and 38 one position toward sealing station 45. When belts 37 and 38 stop, a controller (not shown) actuates pneumatic cylinder 101 to urge assembly 89 of sealing station 45 upwardly to apply sealing pressure and heat to both the sealed and unsealed edges of the packages. Since the apparatus and method of the present invention apply heat and sealing pressure substantially simultaneously to both edges of the package, it does not matter how the operator inserts the packages into receiving station 33. Again, the heated sealing dies are maintained at a temperature of about 175° C. The controller (not shown) maintains the dies in a closed position under a pressure of 60±5 p.s.i. for about 1.5 seconds. Then, the dies are opened by retracting actuator 101. If the controller detects that any of the sealing time, pressure, or temperature values are out of range, the controller actuates pneumatic cylinder 57 at an appropriate time to cause the packages sealed under improper conditions to fall into waste receptacle 61.

From the foregoing, it may be seen that the method and apparatus of the present invention are well adapted to overcome the shortcomings of the prior art. By substantially simultaneously sealing both the sealed and unsealed edges, the opportunity for operator error is virtually eliminated. The present invention results in increased yield of high quality packages.

Although a preferred embodiment of the invention has been described herein with reference to the accompanying drawings, those skilled in the art will appreciate that various alternatives and modifications thereof are within the scope and spirit of the invention as set forth in the appended claims.

What is claimed is:

1. Apparatus for sealing unsealed individual packages of surgical sutures, said packages being generally rectangular including first and second sealed ends and a pair of sides with one side being sealed and the opposite side being unsealed, which comprises:

a loading station adapted to receive individual unsealed packages;

a discharge station adapted to discharge individual sealed packages;

a belt driven in a path to move individual packages between said loading station and said discharge station;

a sealing station positioned along the path of said belt between the loading station and the discharge station, said sealing station comprising:

a first sealing die including a pair of sealing surfaces, said sealing surfaces of said first sealing die being spaced apart from each other a distance substantially equal to the distanced between said seal and unsealed sides;

a second sealing die including a pair of sealing surfaces, said sealing surfaces of said second sealing die being spaced apart from each other a distance substantially equal to the distance between said sealing surfaces of said first sealing die, and said first and second sealing dies being spaced apart from each other; and, means for moving said first and second sealing dies into sealing contact with a package positioned therebetween each time an individual package enters the sealing station, whereby both the sealed and unsealed sides of the individual packages are sealed at the same time regardless of the orientation of said first and second sealed ends.

2. The apparatus as claimed in claim 1, further comprising means for heating the sealing surfaces of one of said sealing dies.

3. The apparatus as claimed in claim 1, wherein said loading station comprises a pair of side walls spaced apart from each other a distance less than the length and greater than the width of said packages.

4. The apparatus as claimed in claim 1, wherein said belt includes a plurality of lugs, said lugs being linearly spaced apart on said belt at a distance substantially equal to the length of said packages.

5. The apparatus as claimed in claim 1, further comprising:

a sealed package receptacle positioned adjacent said discharge station;

a waste receptacle positioned adjacent said discharge station;

and wherein said discharge station comprises:

means for placing properly sealed packages in said sealed package receptacle; and, means for selectively placing sealed packages in said waste receptacle.

6. The apparatus as claimed in claim 5, wherein said discharge station comprises a ramp positioned to receive packages from said belt and feed packages into said sealed package receptacle.

7. The apparatus as claimed in claim 6, wherein said means for placing improperly sealed packages in said waste receptacle comprises means for moving said ramp out of position to receive packages, thereby allowing packages to move from said belt into said waste receptacle.

8. The apparatus as claimed in claim 1, wherein said sealing station comprises means for aligning the package between the sealing dies.

9. The apparatus as claimed in claim 8, wherein said means for aligning the package between the sealing dies comprises:

a first alignment bar positioned on one side of said sealing dies;

a second alignment bar positioned on the other side of said sealing dies; and, means for moving at least one said alignment bars toward the other of said alignment bars.

10. The apparatus as claimed in claim 9, wherein:

said first alignment bar is fixedly positioned with respect to said sealing dies; and, said second alignment bar is movably positioned with respect to said sealing dies.

11. The apparatus as claimed in claim 10, comprising means for moving said second alignment bar toward and away from said first alignment bar.

12. Apparatus for sealing unsealed packages of surgical sutures, said individual packages being generally rectangular including first and second sealed ends and a pair of sides with one side being sealed and the opposite side being unsealed, which comprises:

a loading station adapted to receive unsealed individual packages two at a time side by side oriented with either said first or second end first;

a discharge station adapted to discharge sealed individual packages;

a pair of belts driven in a path to move individual packages side by side between said loading station and said discharge station;

a sealing station positioned along the path of said belt between the loading station and the discharge station, said sealing station comprising:

a fixed sealing die including a pair of spaced apart inner sealing surfaces and a pair of spaced apart outer sealing surfaces;

a movable sealing die including a pair of spaced apart inner sealing surfaces and a pair of spaced apart outer sealing surfaces, said first and second sealing dies being spaced apart from each other; and, means for moving said movable sealing die toward said fixed sealing die, each time an individual package enters said sealing station whereby both the sealed and unsealed sides of the individual packages are sealed at the same time regardless of the orientation of said first and second ends;

and means for aligning said packages between the sealing dies, said means for aligning said packages comprising:

a first alignment bar positioned between the inner sealing surfaces of said sealing dies;

a pair of second alignment bars positioned outboard of the outer sealing surfaces of said sealing dies; and, means for moving said second alignment bars in toward said first alignment bar prior to moving said movable sealing die toward said fixed sealing die.

13. The apparatus as claimed in claim 12, further comprising means for heating the sealing surfaces of said fixed sealing die.

14. The apparatus as claimed in claim 12, wherein each of said belts includes a plurality of lugs, said lugs being linearly spaced apart on each of said belts at a distance substantially equal to the length of said packages.

15. The apparatus as claimed in claim 12, further comprising:

a sealed package receptacle positioned adjacent said discharge station;

a waste receptacle positioned adjacent said discharge station;

and wherein said discharge station comprises:

means for placing properly sealed packages in said sealed package receptacle; and, means for selectively placing sealed packages in said waste receptacle.

16. The apparatus as claimed in claim 15, wherein said means for placing properly sealed packages in said sealed package receptacle comprises a ramp positioned to receive packages from said belt and feed packages into said sealed package receptacle.

17. The apparatus as claimed in claim 16, wherein said means for selectively placing sealed packages in said waste receptacle comprises means for moving said ramp out of position to receive packages, thereby allowing packages to move from said belt into said waste receptacle.

18. The apparatus as claimed in claim 12, wherein said movable sealing die is floatingly mounted with respect to said fixed sealing die.

19. A method of sealing unsealed surgical suture packages, said unsealed surgical suture packages including a bottom foil sheet with a heat sealable coating on its top surface and top foil sheet with a heat sealable coating on its bottom surface, said unsealed surgical suture packages being generally rectangular with one sealed edge and one unsealed edge, which comprises the step of:

aligning said unsealed surgical suture package between said sealing dies such that each said unsealed edge and said sealed edge is disposed between opposed sealing surfaces of said sealing dies, placing an unsealed surgical suture package into a receiving station, and, conveying said unsealed surgical suture package from said receiving station to a position between said sealing dies, conveying a sealed surgical suture package from a position between said sealing dies to a sealed package receptacle when said surgical suture package is properly sealed conveying a sealed surgical suture package from a position between said sealing dies to a waste receptacle when said surgical suture package is improperly sealed, applying heat and sealing pressure substantially simultaneously to both the sealed edge and the unsealed edge of an unsealed surgical suture package, thereby forming a sealed surgical suture package.

20. The method as claimed in claim 19, wherein said step of applying heat and sealing pressure includes the steps of:

placing said unsealed surgical suture package between a first sealing die and a second sealing die, each of said first and second sealing dies including pair of spaced apart sealing surfaces; and, moving said first and second sealing dies toward each other.

21. The method as claimed in claim 19, further comprising the step of heating the sealing surfaces of one of said sealing dies.

* * * * *